United States Patent [19]

Kakigi

[11] 4,297,688

[45] Oct. 27, 1981

[54] PHOTOELECTRIC SMOKE SENSING AND ALARMING DEVICE

[75] Inventor: Takao Kakigi, Tokyo, Japan

[73] Assignee: Cybernet Electronics Corp., Kawasaki, Japan

[21] Appl. No.: 109,145

[22] Filed: Jan. 2, 1980

Related U.S. Application Data

[63] Continuation-in-part of Ser. No. 107,041, Dec. 26, 1979, which is a continuation of Ser. No. 942,186, Sep. 14, 1978, abandoned.

[30] Foreign Application Priority Data

Sep. 30, 1977 [JP] Japan ..... 52-131414[U]

[51] Int. Cl.[3] ..... G08B 17/10

[52] U.S. Cl. ..... 340/630; 250/574

[58] Field of Search ..... 340/630; 250/573, 574, 250/575, 564, 577; 356/438, 439

[56] References Cited

U.S. PATENT DOCUMENTS 3,917,956 11/1975 Malinowski ..... 340/630 X 3,946,241 3/1976 Malinowski ..... 340/630 X 4,075,499 2/1978 Malinowski ..... 340/630

*Primary Examiner*—Caldwell, Sr., John W.

*Assistant Examiner*—Daniel Myer

*Attorney, Agent, or Firm*—Oblon, Fisher, Spivak, McClelland & Maier

[57] ABSTRACT

A photoelectric smoke sensing and alarming device capable of discriminating the smoke generated by a fire from other smokes such as cigarette smoke. The device has a chamber into which the smoke is introduced. The chamber accommodates a light-emitting element adapted to emit a light beam in the form of pulses and a light-receiving element sensitive to the scattering of light due to the presence of the smoke in the chamber. The output from the light-receiving element is delivered to an amplifier which in turn delivers an output to a gate circuit having a level comparator adapted to compare the level of the output from the amplifier with a reference sensing level. Means are provided for actuating an alarming circuit only when more than two successive pulses of level exceeding the reference sensing level are generated.

1 Claim, 2 Drawing Figures

PHOTOELECTRIC SMOKE SENSING AND ALARMING DEVICE

CROSS-REFERENCE TO RELATED APPLICATIONS

This application is a Continuation-In-Part of U.S. application Ser. No. 107,041 filed Dec. 26, 1979, which is a Continuation of U.S. application Ser. No. 942,186 filed Sept. 14, 1978 and now abandoned.

BACKGROUND OF THE INVENTION

1. Field of the Invention

The present invention relates to a photoelectric smoke sensing and alarming device. More particularly, the invention is concerned with a photoelectric smoke sensing and alarm device capable of discriminating the smoke of a fire from smoke having different flow patterns such as cigarette smoke, dust-suspending air and the like, so as not to be actuated erroneously by the smoke other than that generated by a fire.

2. Description of the Prior Art

There have been proposed and used various types of photoelectric smoke sensing and alarming devices in which the smoke gas generated in the initial stage of a fire is introduced into a chamber accommodating light-emitting and light-receiving elements, so that the smoke is sensed as it interrupts the light to be received by the light-receiving element. In this type of device, the chamber has an opening through which the gas suspending the smoke particles is introduced into a dark chamber. At the same time, the sensing output of the light-receiving element is amplified before it is delivered to the alarm circuit. The sensitivity of the device can be adjusted by changing the gain of the amplifier.

In case of smoke generated by a fire, the smoke is gradually and continuously diffused and spread, and the density or thickness of the smoke increases as the time elapses, while smoke from other sources, such as cigarette smoke and dust-suspending air, exhibits different pattern of flow. However, if the sensing circuit is adjusted to be actuated at a high sensitivity, it cannot discriminate the pattern of the smoke of fire from those of other smoke sources. Consequently, the device often issues an alarm signal erroneously upon sensing smoke other than that of a fire.

The erroneous operation of the device is caused also by a scattering of light in the chamber and by scattered light coming from the outside of the chamber entering the chamber. These are closely related to the ease by which the gas is introduced into the chamber, as well as to the construction for preventing the scattering of the light, and also to other factors such as the sensitivity of the sensing circuit and signal to noise ratio.

SUMMARY OF THE INVENTION

It is therefore an object of the invention to overcome the above-described problem of the prior art by providing an improved photoelectric smoke sensing and alarm device.

To this end, according to the invention, there is provided a photoelectric smoke sensing and alarm device in which an alarm is generated, irrespective of the construction of the chamber, only when more than two sensing pulses are delivered successively in synchronization with the pulses of the emitted light, which sensing pulses are generated when a predetermined sensing level is reached, in accordance with the flow pattern of the fire smoke to be sensed.

These and other objects, as well as advantageous features of the invention, will become clear from the following description of the preferred embodiment taken in conjunction with the accompanying drawings.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
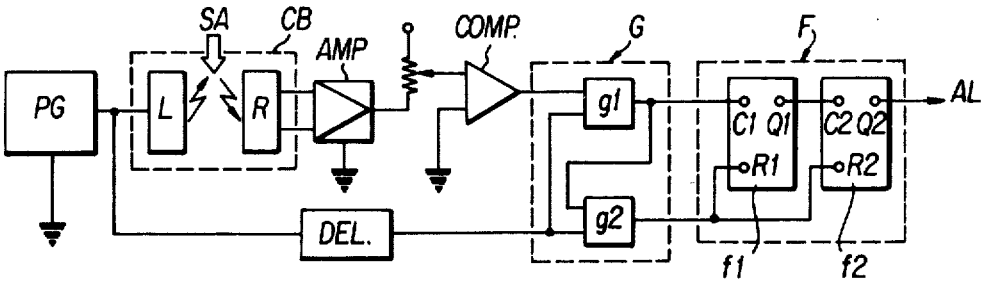
FIG. 1 is a block diagram of a photoelectric smoke sensing and alarming device embodying the present invention, and FIGS. *2a–2f* are charts showing the states of major parts of the circuit as shown in FIG. 1.

Referring first to FIG. 1, which is a block diagram of the whole part of a device in accordance with the invention, a light-emitting element L connected to a pulse generator PG is adapted to emit a light beam in the form of pulses of a predetermined constant period. The sensing output from a light receiving element R, generated as a result of a flow of a smoke SA into a chamber CB, is delivered to a gain-adjustable amplifier AMP and then through a thresholding comparator COMP to one input of gate circuit G. A delay circuit DEL is adapted to provide a delayed pulse output in synchronization with the output of comparator COMP, i.e. with the clock period of the threshold detected pulse produced by generator PG. The threshold comparator COMP compares the level of sensing output with a reference sensing level EB in the flow pattern of smoke as shown in FIG. *2a*. The gate circuit G has a terminal for receiving the output from the comparator COMP and another terminal for receiving the output from the synchronous delayed output from the delay circuit DEL, as well as two output terminals.

The light-receiving body R is sensitive to the pulsed light from the LED L driven in accordance with the period of the clock pulses from the pulse generator. Since the leading edge of the sensed output of the light-receiving body is sluggish and is accompanied by a time delay, the amplified output representative of the detection output is made to coincide with the timing applied to the gate circuit equipped with a level comparator. Hence, the delay circuit DEL is inserted between the pulse generator and the other input terminal of the gate circuit having the level comparator.

The outputs of the gate circuit G are applied to the C1 and R1 input terminals of an RS flip-flop circuit F, which is adapted to deliver a signal to an alarming circuit AL in accordance with the states of the signals applied to the two C1 and R1 input terminals. These input terminals are connected, respectively, to the output terminals of the gate circuit.

The flip-flop circuit F serves as a counter or sequential circuit. The enable line internal to the gate circuit G, as shown in FIG. 1, when there is no output signal from gate g1, restores the smoke detector to the start state when several individual flip-flops of the flip-flop circuit F are reset by g2.

Figure 2:
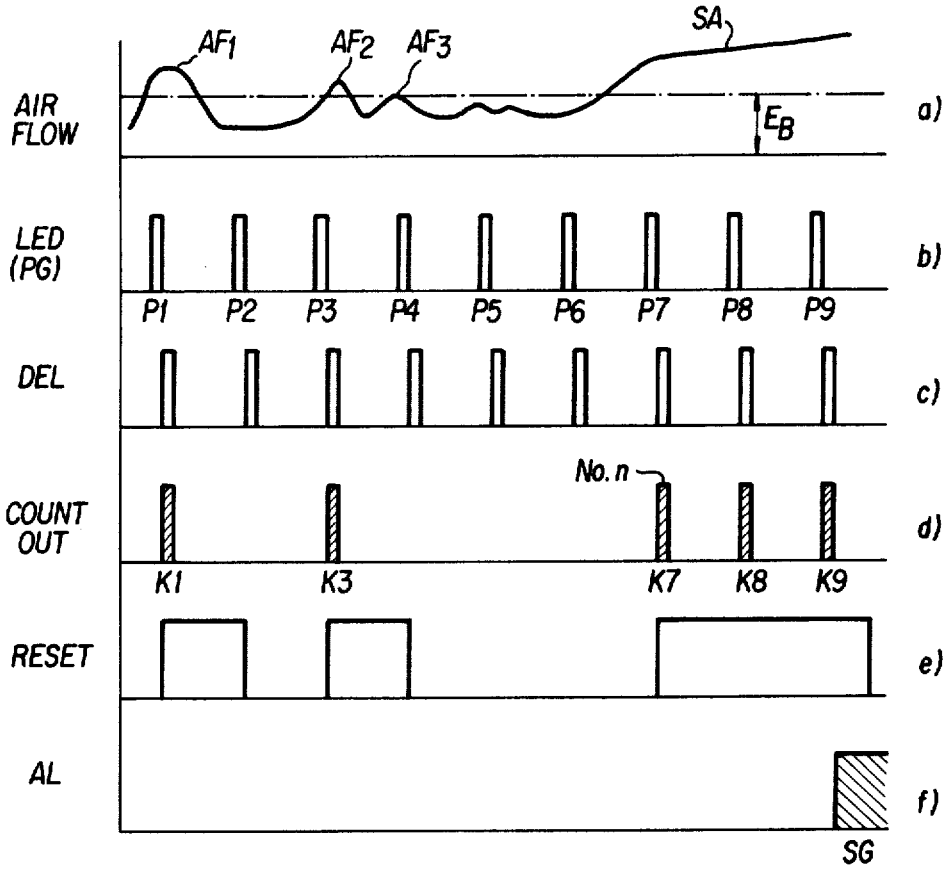

Referring now to FIG. 2*a*, the curve there shown illustrates the thickness distribution of gas before it is introduced into the chamber. In case of smoke from a cigarette, the thickness is irregularly changed and may incidently exceed the predetermined reference sensing level EB, as at peaks AF1 to AF3.

In sharp contrast to the above, the smoke SA generated by a fire exhibits a flow pattern in which the thickness is gradually increased as the time elapses and does not come down below the reference level EB once it exceeds the latter.

FIG. 2*b* shows pulse trains generated by the pulse generator PG. The light receiving element is driven in synchronization with the pulses.

FIG. 2*c* shows pulses of FIG. 2*b* delayed by delay circuit DEL. It will be seen that isolated pulses K1 and K3 are generated in response to the peaks AF1 and AF2, while three successive sensing pulses K7 to K9 are generated in response to the increase of the smoke thickness due to a fire.

According to the invention, the alarm circuit is not actuated by the isolated sensing pulse such as K1 and K3. Namely, the signal SG for actuating the alarm circuit is delivered from the output terminal of the flip-flop as shown at FIG. 2*f*. The period over which the alarm is generated, i.e. the period over which the logical signal "1" appears at the output terminal of the flip-flop circuit F is given as a product of the period at which the clock pulses are delivered by the pulse generator and the number of the sensing pulses generated.

Recapitulating, the present smoke detector has been adapted to reduce erroneous information resulting from error signals, and operates as follows. Namely, on the assumption that there is little probability of an overlap, during a pulse generation period, of the generation of erroneous information inferable from the flow pattern of a fluid, and the generation of the true information when smoke is actually present, the alarm will be actuated for an interval which is m times the period of the clock pulses only if continuous detection pulses of at least n in number are provided at the output from the gate circuit having the level comparator.

Causes of error signal generation such as external light or induced surge, which do not depend upon the flow pattern of the aforesaid fluid, can be eliminated by arranging the photo electric sensors (L and R) within the chamber, and by adding means which prevent obstructing signals from entering the detector circuit. The present smoke detector therefore rigidly treats information as smoke detection information only when there is a transmission of the continuous detection pulses of at least the number n.

In the present invention the inverted signals from the gate circuit having the level comparator are counted as smoke detection pulses, and all of the stages which follow the gate circuit may be fabricated using digital circuitry.

As has been described, in the device of the invention, the alarm instruction is not generated unless the sensing pulse are continuously when the smoke density exceeds a predetermined reference level. Therefore, the device of the invention can easily discriminate the smoke generated by a fire from other kinds of smoke and, therefore, the occurrence of erroneous alarming upon sensing smoke from other sources is minimized.

In addition, the troublesome work of adjusting the gain of the amplifier, which has been necessary in the conventional device, is eliminated.

Further, according to the invention, it becomes possible to determine the characteristics of the sensing circuit solely on the basis of the difference of the flow pattern between the smoke generated by a fire and other smoke, if the influence of the scattering of the light in the chamber is made negligibly small.

Obviously, numerous additional modifications and variations of the present invention are possible in light of the above teachings. It is therefore to be understood that within the scope of the appended claim, the invention may be practiced otherwise than as specifically described herein.

What is claimed as new and desired to be secured by Letters Patent of the United States is:

1. A photoelectric smoke sensing and alarming device of a type having a pulse generator, a chamber, a light emitting element disposed in said chamber and adapted to emit a light beam in the form of pulses in cooperation with said pulse generator, and a light-receiving element disposed in said chamber and adapted to receive the light from said pulses of light beam, so as to sense the presence of smoke in said chamber through a detection of scattering of said light beem caused in said chamber by said smoke, comprising:

an amplifier having gain control and connected to said light-receiving element for producing an output upon reception of light by said light-receiving element;

a threshold detecting comparator for producing a pulse output when the output of said amplifier exceeds a predetermined threshold level;

a delay circuit coupled to the pulse generator for producing a delayed pulse output in synchronism with the output of the comparator;

a gate circuit having a pair of inputs respectively connected to the output of the comparator and the output of the delay circuit for delivering a first output upon simultaneous receipt of output pulses from said comparator and said delay circuit and for producing a second output upon the occurrence of the delayed output pulse of the delay circuit in the absence of the output pulse of said comparator; and a flip-flop circuit coupled to said gate circuit and adapted to be set by the first output from said gate circuit, wherein an alarm is generated over a time length which is at least as long as the time between successive of said pulses generated by said pulse generator, only when at least n ($n > 2$) successive of said first outputs are delivered by said gate circuit to said flip-flop circuit, said second output of said gate circuit being used to reset the flip-flop circuit in the absence of successive first output signals from said gate circuit.

* * * * *